United States Patent [19]

Yan

[11] 4,391,782

[45] Jul. 5, 1983

[54] IN SITU URANIUM LEACHING USING HIGH PRESSURE $CO_2/O_2$ SYSTEM TO OVERCOME CHLORIDE ION INHIBITION

[75] Inventor: Tsoung-Yuan Yan, Philadelphia, Pa.

[73] Assignee: Mobil Oil Corporation, New York, N.Y.

[21] Appl. No.: 221,556

[22] Filed: Dec. 31, 1980

[51] Int. Cl.[3] ..... C22B 60/02

[52] U.S. Cl. ..... 423/7; 423/18; 423/20; 299/4

[58] Field of Search ..... 423/7, 6, 18, 20; 299/4, 5

[56] References Cited

U.S. PATENT DOCUMENTS

| | | | |
|---|---|---|---|
| 3,130,960 | 4/1964 | Martin | 299/5 |
| 4,105,253 | 8/1978 | Showalter | 423/18 X |
| 4,235,850 | 11/1980 | Otto, Jr. | 423/7 |

FOREIGN PATENT DOCUMENTS

| | | | |
|---|---|---|---|
| 197807 | 7/1978 | Fed. Rep. of Germany | 423/7 |

*Primary Examiner*—Deborah L. Kyle
*Assistant Examiner*—Matthew A. Thexton
*Attorney, Agent, or Firm*—Charles A. Huggett; James F. Powers, Jr.; John K. AboKhair

[57] ABSTRACT

A process is described for improving yield and leaching rates of mineral values in uranium-bearing formations associated with high brine aquifers by using high pressure $CO_2$/oxidant in the leaching solution. The high pressure $CO_2$ overcomes the inhibiting effect of NaCl on the rate of leaching. Uranium is recovered at the well head by ion exchange at a pH of about 4.5 to about 5.0 either under pressure to keep the $CO_2$ in solution or with provision for $CO_2$ recovery and recycle.

14 Claims, No Drawings

IN SITU URANIUM LEACHING USING HIGH PRESSURE $CO_2/O_2$ SYSTEM TO OVERCOME CHLORIDE ION INHIBITION

FIELD AND BACKGROUND OF THE INVENTION

This invention relates generally to in situ leaching of mineral values, particularly uranium values, from subterranean formations. More specifically, this invention relates to processes for the recovery of uranium from formations associated with high brine aquifers. Improved yields and leaching rates are obtained while minimizing deleterious environmental impact such as groundwater and air pollution.

Uranium formations in high brine aquifers have been discovered in South Texas. These formations present special obstacles to leaching the uranium in situ because of the high brine content of the aquifers, such waters generally being saturated in $CaCO_3$ and containing very high levels of NaCl. A typical high brine content aquifer, for example the West Ranch water, contains 60 g/l NaCl, 3 g/l $CaCl_2$, 1 g/l $MgCl_2$ and 0.5 g/l $NaHCO_3$.

These formations present serious problems for uranium leaching. Thus, the high carbonate content of the aquifers makes it economically impractical to employ a conventional acid leaching technique. On the other hand, the high calcium levels in such aquifers make it impossible to leach with an alkaline carbonate solution without plugging the formation.

In addition, the high NaCl content in such aquifers presents different, but more significant, problems. A marked decrease in the leaching rate itself is experienced. For example, in waters with a NaCl concentration of 60 g/l, the leaching rate is slower than the leaching rate in fresh water by a factor of 5. Moreover, chloride ion interferes with the recovery of uranium by ion exchange processes.

As an alternative to acid leaching, $CO_2/O_2$-water systems have been used as lixiviants for leaching uranium formations. $CO_2/O_2$-water lixiviants are preferred to the ammonium carbonate/bicarbonate systems since the latter create the possible threat of ground water contamination through ammonium ion exchange with calcium and sodium ions contained in clays in the subterranean formation. The overall reaction using the $CO_2/O_2$ lixiviant, i.e. oxidation of uranium to the hexavalent state and solubilization thereof, is shown by the following equation:

$$UO_2(S)+[O]+3HCO_3^- \rightarrow UO_2(CO_3)_3^{-4}+H^++H_2O$$

SUMMARY AND DETAILED DESCRIPTION OF THE INVENTION

The process of this invention overcomes the problems of recovering uranium from formations in high brine content aquifers. Thus, the process of this invention allows for oxidation of uranium to the hexavalent state and for its solubilization, notwithstanding the presence of chloride ion. Moreover, in accordance with the invention the uranium leaching rate, notwithstanding the presence of the chloride leaching inhibitor, has been increased to the level of the fresh water leach.

It was found in connection with this invention that the decrease in uranium leaching in high brine aquifers is attributable to the chloride ion content of such aquifers. Thus, removal of the chloride ion from the leach solution was found to promptly increase uranium leaching rate. Also, substitution of $Na_2SO_4$ for the NaCl, at the same ionic strength, was found not to decrease the leaching rate as did NaCl.

It was also discovered, unexpectedly, that high pressure $CO_2$ overcomes the inhibiting effect of NaCl on the rate of uranium leaching. One aspect of the process of this invention therefore involves injecting an oxidant and $CO_2$ under pressure into the formation in the high brine aquifers to leach the uranium. The $CO_2$ may be introduced at a pressure of 10 psig, but preferably is introduced at a pressure greater than 10 psig and up to a pressure of about 100 psig, and most preferably at a pressure ranging from about 20 to about 50 psig.

Not only was it discovered that high pressure $CO_2$ tended to increase the rate of uranium leaching inhibited by chloride ion, but it was discovered also that as the pressure of the $CO_2$ was increased from about 10 psig to 45 psig, the rate of leaching increased to the level of a fresh water leach. Further, as the $CO_2$ pressure is increased, another advantage is obtained, viz., the pH of the leach solution decreases since no base is added directly into the system. For example, the pH of such a leach solution is estimated to be 4.9 at a $CO_2$ pressure of 10 psi, and the pH is estimated to be 4.5 at a $CO_2$ pressure of 45 psi.

The importance of the additional advantage of this invention resulting from an increased $CO_2$ pressure (thereby decreasing pH of the leach solution) is related to the high $CaCO_3$ (calcite) content of the high brine aquifers. Increasing acidity, and lower pH, favors solubilization of the $CaCO_3$, rather than its precipitation. Accordingly, increasing acidity of the leach solution substantially avoids precipitation of $CaCO_3$ and thus avoids substantial plugging of the uranium formation by calcite.

The oxidant used in conjunction with the high pressure $CO_2$ oxidizes the uranium values to the hexavalent state which is soluble in the leachate. When the oxidant is a gas, such as air or oxygen, it too is injected into the uranium formation at pressures exceeding atmospheric pressure. In a typical run, the pressure of $O_2$ injected into the formation is at least 5 psig relative to the static pressure at the well bore. The pressure of the gaseous oxidant will vary, depending on the conditions of any given leaching operation. The desired pressure is that of the well bore pressure, at which pressure the solution is saturated. The amount of oxidant required depends not only on the uranium content but also on the amount of reducing compounds other than uranium which are contained in the formation and act as oxygen scavengers. The oxidant may be injected into the formation alone, and prior to or after injection of the $CO_2$ into the formation, but preferably is injected into the formation along with the pressurized $CO_2$.

The $CO_2$ and gaseous oxidant can be injected into the formation prior to passing the lixiviant into the formation, but preferably are injected along with the aqueous lixiviant.

Another aspect of the process of this invention relates to recovery of the uranium from the leachate. The recovery of uranium from high brine leachate cannot be carried out using conventional ion exchange conditions. Thus, it has been found in connection with this invention that the pH of the leachate to be passed over the ion exchange resin is of critical importance. Strong base anion exchange resins conventionally used in uranium recovery can be employed but if the pH of the leachate leaving the well is not at a pH of 4.5 to 5.0, the pH of the leachate must be adjusted to a pH within this range. Because of the chloride ion content, the pH range of the leachate used in the ion exchange operation for recovery of uranium is more critical and is lower than that of the conventional ion exchange operation. Adjustment of pH of the leachate will generally involve acid addition to the leachate.

The specific strong base anion exchange resins which can be used for uranium recovery are not critical. Generally, such ion exchange resins contain quaternary ammonium functional groups as their active ion constituent. Pyridinium groups may also be substituted in part for the amine groups in some resins developed specifically for use in uranium recovery. The strong base anionic exchange resins are highly ionized, usable over a wide pH range, stable in the absence of strong reducing or oxidizing agents, insoluble in most common solvents, and will withstand temperatures up to about 60° C. Conventional anionic ion exchange resins are disclosed, for example, in Merritt, R. C., The Extractive Metallurgy of Uranium, Colorado School of Mines Research Institute, 1971, pp. 138–147.

The barren leachate, depleted after ion exchange, can be used for recycle; for example, it can be made up with $CO_2$ and $O_2$ for recycle into the leaching stage of the process.

The system of equipment for leaching uranium in situ generally includes at least one inflow well and a production well, both cased with stainless steel pipe and with stainless steel screens placed through the ore zone. A submersible pump is suspended in the bottom of the production well, and the wells are sealed above the ore body. Water is introduced initially through a high pressure jet until the wells are capable of a satisfactory rate of inflow. In accordance with usual practice, the pregnant leachate obtained by this invention can be produced at the surface for processing via the submersible pump. At the surface, the pregnant leachate can be passed through a calcium removal means (e.g., a calcite precipitator such as a "Spiractor Precipitator" manufactured by Permutit Company, Paramus, N.J.) to physically remove substantial amounts of the dissolved calcium from the leachate. The leachate, depleted in calcite, can then be stored or passed directly to a strong base ion exchange resin.

Modification of existing equipment in connection with this invention could include a $CO_2$ recovery system, of the conventional type used in gas fields, to avoid loss of $CO_2$ from the leachate if pressure is reduced at the well head. Alternatively, the surface equipment can be kept tight to maintain the $CO_2$ in solution at pressures of about 20–30 psig.

The foregoing description of this invention has been directed to particular details in accordance with the requirements of the Patent Act and for purposes of explanation and illustration. It will be apparent, however, to those skilled in this art that many modifications and changes may be made without departing from the scope and spirit of the invention. It is further apparent that persons of ordinary skill in this art will, on the basis of this disclosure, be able to practice the invention within a broad range of process conditions. It is my intention in the following claims to cover all such equivalent modifications and variations as fall within the true scope and spirit of my invention.

What is claimed is:

1. An improved process for the recovery of mineral values from a mineral-bearing subterranean formation, wherein the subterranean formation has a sufficient chloride concentration to substantially inhibit the leaching rate of the mineral values therein, comprising the steps of:

(a) penetrating the formation with at least one injection well and at least one production well in communication with the injection well;

(b) introducing into the formation an aqueous leaching solution containing an oxidant and carbon dioxide wherein the carbon dioxide is introduced under sufficient pressure to substantially overcome the inhibiting effect of the chloride ion on the leaching rate; and (c) producing the aqueous leaching solution containing oxidized and solubilized mineral values.

2. The process of claim 1 wherein the oxidant is selected from the group consisting of oxygen, oxygen-containing gas, air or any combination thereof.

3. The process of claim 2 wherein the gaseous oxidant is injected into the formation prior to the injection of the aqueous leaching solution containing carbon dioxide.

4. The process of claim 1 wherein the mineral values are uranium values.

5. The process of claim 1 wherein the carbon dioxide is introduced into the leaching solution at bottom-hole location of the injection well.

6. The process of claim 1 wherein the carbon dioxide is introduced at a pressure of about 10 to about 100 psig.

7. The process of claim 1 wherein the carbon dioxide is introduced under sufficient pressure to give the produced aqueous leaching solution a pH of about 4.0 to about 5.0.

8. The process of claim 7 further comprising the step of passing the produced solution through an ion exchange resin to recover mineral values therefrom.

9. An improved process for the in situ recovery of uranium values from a uranium-bearing subterranean formation, having formation fluids with a sufficient chloride concentration to substantially inhibit the leaching rate of the uranium value therein, comprising the steps of:

(a) penetrating the formation with at least one injection well and at least one production well in communication with the injection well;

(b) introducing into the formation an aqueous leaching solution containing an oxidant and carbon dioxide wherein the carbon dioxide is introduced under sufficient pressure to substantially improve the uranium-leaching rate and to give the formation fluids a pH of from about 4.0 to about 5.0;

(c) producing pregnant leaching solution containing uranium values and having a pH of from about 4.0 to about 5.0; and (d) passing the produced pregnant leaching solution through an ion exchange resin to recover uranium values therefrom.

10. The process of claim 9 wherein the oxidant is selected from the group consisting of oxygen, oxygen-containing gas, air or any combination thereof.

11. The process of claim 10 wherein the oxidant is introduced into the formation prior to the introduction of the aqueous leaching solution.

12. The process of claim 9 wherein the carbon dioxide is introduced into the formation to the injection of the aqueous solution.

13. The process of claim 9 wherein the carbon dioxide is introduced into the leaching solution at bottom-hole location of the injection well.

14. The process of claim 9 wherein the carbon dioxide is introduced at a pressure of about 10 to about 100 psig.

* * * * *